US010189140B2

(12) United States Patent
Boeck et al.

(10) Patent No.: US 10,189,140 B2
(45) Date of Patent: Jan. 29, 2019

(54) HAND-HELD MACHINE TOOL HAVING AN ELECTRONICALLY COMMUTATED ELECTRIC MOTOR AS DIRECT DRIVE

(71) Applicant: Robert Bosch GmbH, Stuttgart (DE)

(72) Inventors: Cornelius Boeck, Kirchheim (DE); Daniel Barth, Leinfelden-Echterdingen (DE); Florian Esenwein, Leinfelden-Echterdingen (DE); Manfred Lutz, Filderstadt (DE); Joachim Schadow, Stuttgart (DE); Joerg Maute, Sindelfingen (DE); Joern Stock, Bempflingen (DE)

(73) Assignee: Robert Bosch GmbH, Stuttgart (DE)

( * ) Notice: Subject to any disclaimer, the term of this patent is extended or adjusted under 35 U.S.C. 154(b) by 62 days.

(21) Appl. No.: 15/317,370

(22) PCT Filed: Apr. 14, 2015

(86) PCT No.: PCT/EP2015/058014
§ 371 (c)(1),
(2) Date: Dec. 8, 2016

(87) PCT Pub. No.: WO2015/192994
PCT Pub. Date: Dec. 23, 2015

(65) Prior Publication Data

US 2017/0113319 A1 Apr. 27, 2017

(30) Foreign Application Priority Data

Jun. 17, 2014 (DE) ..... 10 2014 211 615

(51) Int. Cl.
*B24B 23/02* (2006.01)
*B25F 5/00* (2006.01)

(52) U.S. Cl.
CPC ..... *B24B 23/028* (2013.01); *B25F 5/00* (2013.01)

(58) Field of Classification Search
CPC ..... B24B 23/08; B25F 5/00
(Continued)

(56) References Cited

U.S. PATENT DOCUMENTS 8,353,278 B2 * 1/2013 Plaskett ..... B28D 1/04 125/13.01
8,628,380 B2 * 1/2014 Yang ..... F16D 43/21 451/354

(Continued)

FOREIGN PATENT DOCUMENTS

JP 2010-269409 A 12/2010
JP 2013-119129 A 6/2013

(Continued)

OTHER PUBLICATIONS

International Search Report corresponding to PCT Application No. PCT/EP2015/058014, dated Jul. 16, 2015 (German and English language document) (6 pages).

*Primary Examiner* — George Nguyen
(74) *Attorney, Agent, or Firm* — Maginot, Moore & Beck LLP

(57) ABSTRACT

A hand-held machine tool has an electric-motor drive and a machining tool. The electric-motor drive has an electronically commutated electric motor, and the electric-motor drive is provided to drive the machining tool. The electronically commutated electric motor has an outer diameter, and a ratio of the outer diameter of the electronically commutated electric motor to a diameter of the machining tool is a maximum of 0.42.

19 Claims, 2 Drawing Sheets

(58) Field of Classification Search
USPC ..... 451/358–359
See application file for complete search history.

(56) References Cited

U.S. PATENT DOCUMENTS

| | | | | |
|---|---|---|---|---|
| 9,751,186 | B2 * | 9/2017 | Sperl | B24B 23/03 |
| 2005/0245183 | A1 | 11/2005 | Deshpande et al. | |
| 2011/0081846 | A1 * | 4/2011 | Yang | B24B 23/028 451/359 |
| 2011/0171887 | A1 * | 7/2011 | Tanimoto | B24B 23/028 451/359 |
| 2016/0199958 | A1 * | 7/2016 | Wolperding | B25F 5/008 173/46 |

FOREIGN PATENT DOCUMENTS

| | | | |
|---|---|---|---|
| JP | 2013-193133 | A | 9/2013 |
| WO | 2010/087235 | A1 | 8/2010 |
| WO | 2015/018557 | A1 | 2/2015 |

* cited by examiner

HAND-HELD MACHINE TOOL HAVING AN ELECTRONICALLY COMMUTATED ELECTRIC MOTOR AS DIRECT DRIVE

This application is a 35 U.S.C. § 371 National Stage Application of PCT/EP2015/058014, filed on Apr. 14, 2015, which claims the benefit of priority to Serial No. DE 10 2014 211 615.5, filed on Jun. 17, 2014 in Germany, the disclosures of which are incorporated herein by reference in their entireties.

The disclosure relates to a hand-held machine tool comprising an electronically commutated electric motor as direct drive.

BACKGROUND

The prior art discloses hand-held machine tools, in particular angle grinders comprising an electronically commutated electric motor. Hand-held machine tools of this kind are available in various sizes and power classes. They are often difficult to design because, in particular, the geometric sizes of the components and the masses to be incorporated result in hand-held tools which are ergonomically unfavorable in terms of handling.

SUMMARY

In comparison, hand-held machine tools according to the disclosure having the features described below have the advantage of optimally configured ergonomics, handling ability and ease of operation.

A hand-held machine tool advantageously has an electronically commutated electric motor. The electronically commutated electric motor is provided to drive a machining tool. Commutation is performed with the aid of an electronics system in electronically commutated electric motors. As a result, electronically commutated electric motors have a longer service life and a higher performance capability than motors in which commutation is performed with the aid of carbon brushes. Dispensing with the carbon brushes means that there is little wear on the electronically commutated electric motors.

The electronically commutated electric motor drives a machining tool of the hand-held machine tool. It is particularly advantageous when the electronically commutated electric motor drives the machining tool of the hand-held machine tool directly. Here, "directly" is intended to be understood to mean, in particular, that the electronically commutated electric motor is connected to the machining tool without the interposition of a conventional gear unit. A high degree of efficiency with minimum wear is achieved as a result. This creates installation space in the hand-held machine tool which is suitable for accommodating electric motors which are suitable for outputting high torques and therefore can operate as a direct drive with a gear unit being dispensed with. The machining tool of the hand-held machine tool has a diameter $d_{tool}$.

A particularly ergonomic hand-held machine tool is produced when the electronically commutated electric motor has an outside diameter $d_{motor}$ and a ratio of the outside diameter $d_{motor}$ of the electronically commutated electric motor to the diameter $d_{tool}$ of the machining tool is at most 0.42, particularly at most 0.39, but preferably at most 0.32.

The electronically commutated electric motor advantageously has a rotation speed n, wherein the ratio of the rotation speed n of the electronically commutated electric motor to the diameter $d_{tool}$ of the machining tool is preferably at most 28.5 rpm/mm.

In an advantageous embodiment, the electronically commutated electric motor has a height $h_{motor}$, wherein, when there is a sensor element, the height $h_{motor}$ defined including a dimension which is prespecified by the sensor element. If there is no sensor element, the height $h_{motor}$ delimits only the dimensions of the electric motor.

wherein the ratio of the height $h_{motor}$ of the electronically commutated electric motor to the diameter $d_{tool}$ of the machining tool is at most 0.36, particularly at most 0.30, but preferably at most 0.22.

Advantageously, a ratio $(d_{tool}-d_{motor})/n=1$ mm*min/50, particularly 1 mm*min/40, but preferably 1 mm*min/22.

High torques can be generated if the electronically commutated electric motor is an external rotor motor.

High power classes are advantageously achieved if the hand-held machine tool has a mains connection cable.

Flexible handling of the hand-held machine tool is possible if the hand-held machine tool is in the form of a battery-operated hand-held machine tool.

Said advantages also apply, in particular, when the hand-held machine tool is in the form of an angle grinder.

BRIEF DESCRIPTION OF THE DRAWINGS

Exemplary embodiments of a hand-held machine tool according to the disclosure are illustrated in the drawings. When designing a new hand-held machine tool, a person skilled in the art, with knowledge of the parameters essential to the disclosure and the relationships between said parameters, will in an appropriate manner combine those parameters and ratios stated in the following description which are relevant to the type of hand-held machine tool he is dealing with.

In the drawings.

DETAILED DESCRIPTION

Figure 1:
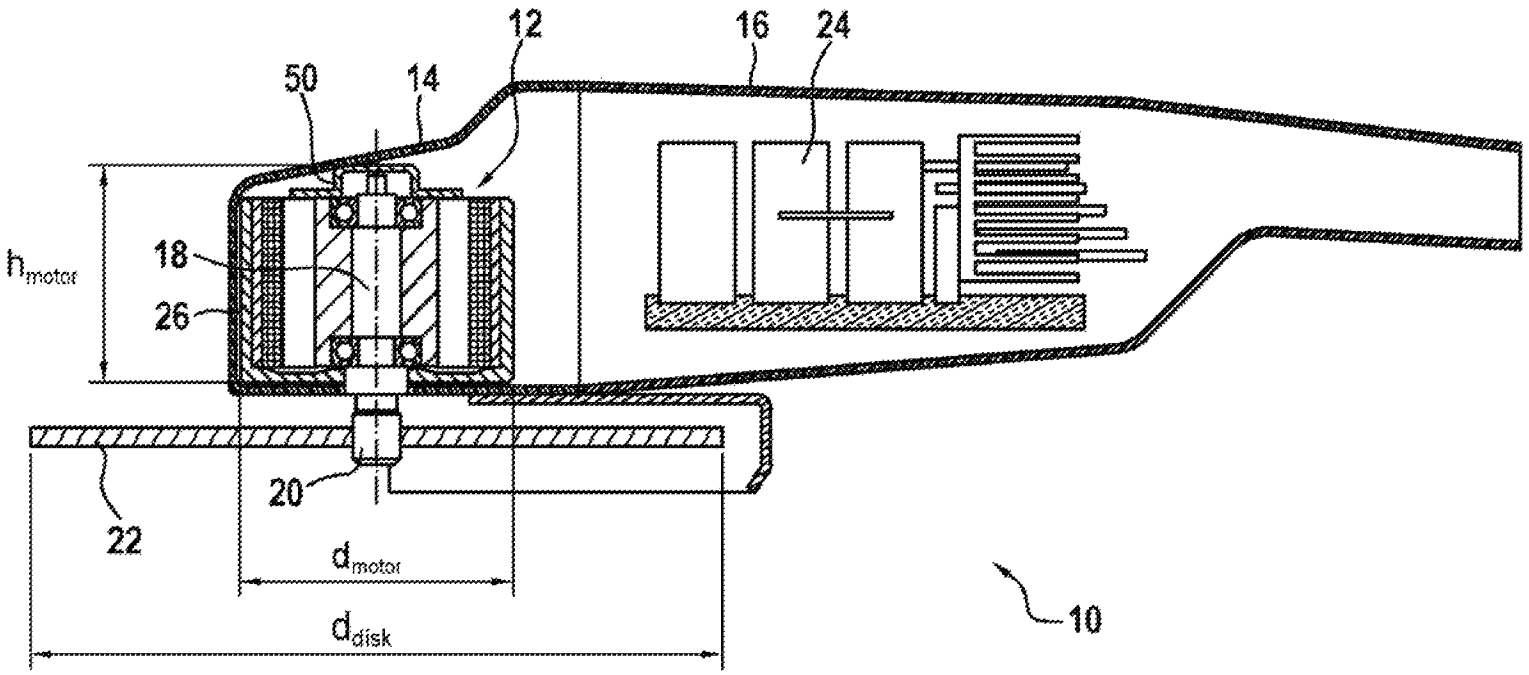
FIG. 1 shows an exemplary embodiment of a hand-held machine tool according to the disclosure.

The hand-held machine tool 10 on which the disclosure is based is illustrated as an angle grinder in FIG. 1. However, other hand-held machine tools are likewise possible according to the disclosure.

A hand-held machine tool 10 of this kind has an electromotive drive 12, a first housing part 14 and a second housing part 16. The electromotive drive 12 is arranged in the first housing part 14. In the exemplary embodiment, the electromotive drive 12 is designed as an electronically commutated electric motor 12 which drives a motor shaft 18. The second housing part 16 is in the form of a handle and extends in a direction away from the first housing part 14. In a different design, a handle can also adjoin the second housing part 16. The motor shaft 18 continues in a tool spindle 20 to which a machining tool 22 is fixed. However, it is also feasible for the motor shaft 18 to be connected to the tool spindle 20 by means of a clutch. The machining tool 22 is driven in rotation by the electronically commutated electric motor 12. The machining tool 22 may be a grinding, cutting or polishing disk. In the exemplary embodiment, the machining tool 22 has a diameter $d_{tool}$.

An electronics system 24 for supplying current to the electronically commutated electric motor 12 is arranged in the second housing part 16. However, it is also feasible for the electronics system 24 to be arranged in the first housing part 14 or in its own housing part.

The electronically commutated electric motor 12 has an outside diameter $d_{motor}$. An optimum design in terms of handling of the hand-held machine tool 10 is achieved by the ratio of the outside diameter $d_{motor}$ of the electronically commutated electric motor 12 to the diameter $d_{tool}$ of the machining tool 22 being at most 0.42, particularly 0.39, but preferably 0.32. In the said range, the hand-held machine tool is of optimum design in terms of size, weight and center of gravity of the electronically commutated electric motor. This means a high degree of user-friendliness for the operator in ergonomic respects.

A further ergonomically good design of the hand-held machine tool 10 is achieved in that a rotation speed n of the electronically commutated electric motor 12 to the diameter $d_{tool}$ of the machining tool 22 is preferably at most 28.5 rpm/mm. At this value, the hand-held machine tool is of optimum design in terms of the power of the electronically commutated electric motor.

A further geometric dimension of the electronically commutated electric motor 12 is defined by a height $h_{motor}$. When a sensor element 50 is present, the height $h_{motor}$ is defined including a dimension which is prespecified by the sensor element 50. If the sensor element 50 is not present, the height $h_{motor}$ delimits only the dimension of the electric motor.

The ratio of the height $h_{motor}$ of the electronically commutated electric motor 12 to the diameter $d_{tool}$ of the machining tool 22 is at most 0.36, particularly at most 0.30, but preferably at most 0.22. In said range, the hand-held machine tool is of optimum design in terms of size and weight. This means a high degree of user-friendliness for the operator in ergonomic respects. A ratio $(d_{tool}-d_{motor})/n$ is ideally 1 mm*min/50, particularly 1 mm*min/40, but preferably 1 mm*min/22.

In the exemplary embodiment in FIG. 1, the electronically commutated electric motor 12 is an external rotor motor. In motors of this kind, a stator, which is fitted with the current-carrying windings, is surrounded by a rotor. The magnetic field is generated by permanent magnets which are arranged in the rotor. The rotor is fastened to the motor shaft 18, while the stator is arranged on a stator support.

However, it is also feasible for the electronically commutated electric motor 12 to be designed as an internal rotor motor. In the case of internal rotor motors, the stator, which is fitted with the current-carrying windings, is located on the motor housing 24. The rotor, which is fitted with the permanent magnets, is connected to the motor shaft 18.

If commutation is required, the angular position of the permanent magnets in the rotor is detected by means of one or more sensors 50 and evaluated by the electronics system 24. Depending on the angular position of the rotor and the desired rotation direction, current is supplied to the relevant windings by the electronics system 24 in order to generate the required torque. However, it is also feasible for commutation to be performed without sensors by detecting a countervoltage which is triggered in the turns of the stator.

The electronically commutated electric motor 12 drives the tool spindle 20 directly, that is to say without the interposition of a conventional gear unit.

In the exemplary embodiment in FIG. 1, the hand-held machine tool 10 is in the form of a mains-operated hand-held machine tool 10. The hand-held machine tool is provided with a mains connection line 32. The mains connection line 32 leads via a bushing 34 into the interior of the hand-held machine tool 10 and to the electronics system 24 and to a power supply unit which forms part of the electronics system 24.

Figure 2:
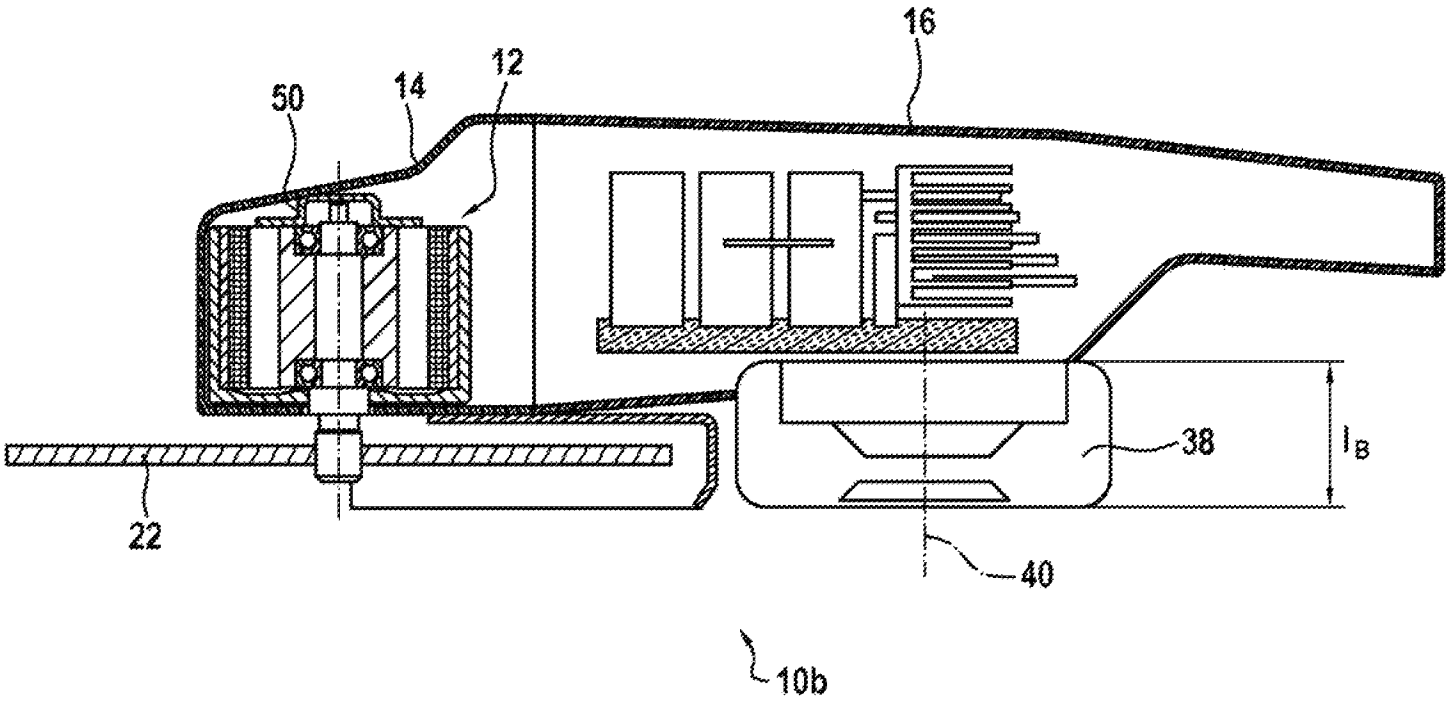
FIG. 2 shows a second exemplary embodiment of the hand-held machine tool according to the disclosure.

In the exemplary embodiment in FIG. 2, the hand-held machine tool 10 is in the form of battery-operated hand-held machine tools 10. A rechargeable battery 38 supplies power to the hand-held machine tool 10 and feeds the electronics system 24. As shown in FIG. 2, the rechargeable battery 38 is at least partially connected to the second housing part 14 of the hand-held machine tool 10. Here, a large portion of a battery length $l_B$ is arranged outside the second housing part 14. A battery axis 40 of the rechargeable battery 38, which battery axis passes through the rechargeable battery 38, is angled here, in particular perpendicular to the axis of main extent of the second housing part 14.

The rechargeable battery 38 comprises, in particular, lithium-ion battery cells. Here, the rechargeable battery 38 comprises one or several rows of battery cells which, in turn, are connected to one another in parallel and/or in series. Lithium-ion rechargeable batteries are distinguished by a high energy density and thermal stability even under high loading, this meaning a high power. A further major advantage is the low level of self-discharging, which has the effect that the rechargeable batteries are also ready for use even over relatively long service lives.

However, it is also feasible for the rechargeable battery 38 to comprise lithium-air cells, lithium-sulfur cells, lithium-polymer cells or the like. Furthermore, the rechargeable battery 38 can be implemented with a geometric design other than the geometric design shown, such as, for example, a cylindrical design which is accommodated, in particular, at least partially by the handle.

The rechargeable battery 38 can be designed as a replaceable rechargeable battery 38. However, it is also feasible for the rechargeable battery 38 to be designed as an integrated unit.

The hand-held machine tool 10 is in the form of an angle grinder. Angle grinders are hand-held machine tools 10 for grinding and cutting metals and similar materials. However, it is also feasible for the hand-held machine tool 10 to be in the form of, for example, an orbital sander, a cup-wheel grinder, a polisher, a concrete grinder or a milling machine.

The invention claimed is:

1. A hand-held machine tool, comprising:

an electromotive drive; and a machining tool having an outside diameter, wherein:

the electromotive drive has an electronically commutated electric motor and is configured to drive the machining tool, the electronically commutated electric motor having a rotation speed, the electronically commutated electric motor has an outside diameter, and a ratio of the outside diameter of the electronically commutated electric motor to a diameter of the machining tool is at most 0.42, wherein a ratio of the rotation speed of the electronically commutated electric motor to the outside diameter of the machining tool is at most 28.5 rpm/mm.

2. The hand-held machine tool as claimed in claim 1, wherein:

the electronically commutated electric motor has a height, and a ratio of the height of the electronically commutated electric motor to the diameter of the machining tool is at most 0.36.

3. A hand-held machine tool, comprising:

an electromotive drive, which has an electronically commutated electric motor and is configured to drive a machining tool, wherein a ratio of the magnitude of the difference between a diameter of the machining tool and an outside diameter of the electronically commutated electric motor to the magnitude of a rotation speed of the electronically commutated electric motor is 1/50 or more.

4. The hand-held machine tool as claimed in claim 1, wherein the electronically commutated electric motor is an external rotor motor.

5. The hand-held machine tool as claimed in claim 1, wherein the electronically commutated electric motor directly drives the machining tool.

6. The hand-held machine tool as claimed in claim 1, wherein the hand-held machine tool is a mains-operated hand-held machine tool.

7. The hand-held machine tool as claimed in claim 1, wherein the hand-held machine tool is a battery-operated hand-held machine tool.

8. The hand-held machine tool as claimed in claim 1, wherein the hand-held machine tool is an angle grinder.

9. The hand-held machine tool as claimed in claim 1, wherein the ratio of the outside diameter of the electronically commutated electric motor to the diameter of the machining tool is at most 0.39.

10. The hand-held machine tool as claimed in claim 1, wherein the ratio of the outside diameter of the electronically commutated electric motor to the diameter of the machining tool is at most 0.32.

11. The hand-held machine tool as claimed in claim 2, wherein the ratio of the height of the electronically commutated electric motor to the diameter of the machining tool is at most 0.30.

12. The hand-held machine tool as claimed in claim 2, wherein the ratio of the height of the electronically commutated electric motor to the diameter of the machining tool is at most 0.22.

13. The hand-held machine tool as claimed in claim 3, wherein the electronically commutated electric motor is an external rotor motor.

14. The hand-held machine tool as claimed in claim 3, wherein the electronically commutated electric motor directly drives the machining tool.

15. The hand-held machine tool as claimed in claim 3, wherein the hand-held machine tool is a mains-operated hand-held machine tool.

16. The hand-held machine tool as claimed in claim 3, wherein the hand-held machine tool is a battery-operated hand-held machine tool.

17. The hand-held machine tool as claimed in claim 3, wherein the hand-held machine tool is an angle grinder.

18. The hand-held machine tool as claimed in claim 3, wherein the ratio is 1/40.

19. The hand-held machine tool as claimed in claim 3, wherein the ratio is 1/22.

* * * * *